US012012676B2

(12) United States Patent
Wörnle et al.

(10) Patent No.: US 12,012,676 B2
(45) Date of Patent: Jun. 18, 2024

(54) TEXTILE TOOL PART PAIR AND METHOD FOR EQUIPPING A TEXTILE MACHINE

(71) Applicant: Groz-Beckert KG, Albstadt (DE)

(72) Inventors: Martin Wörnle, Mössingen (DE); Jörg Sauter, Albstadt (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 17/914,786

(22) PCT Filed: Mar. 29, 2021

(86) PCT No.: PCT/EP2021/058194
§ 371 (c)(1),
(2) Date: Sep. 27, 2022

(87) PCT Pub. No.: WO2021/198201
PCT Pub. Date: Oct. 7, 2021

(65) Prior Publication Data

US 2023/0138793 A1 May 4, 2023

(30) Foreign Application Priority Data

Apr. 1, 2020 (EP) ..... 20167558

(51) Int. Cl.
*D04B 15/02* (2006.01)
*D04B 15/06* (2006.01)
(Continued)

(52) U.S. Cl.
CPC ..... *D04B 15/02* (2013.01); *D04B 15/06* (2013.01); *D04B 27/04* (2013.01); *D04B 35/04* (2013.01); *D04B 35/06* (2013.01)

(58) Field of Classification Search
CPC ..... D04B 15/02; D04B 15/06; D04B 27/04; D04B 35/04; D04B 35/06; B21G 1/02;
(Continued)

(56) References Cited

U.S. PATENT DOCUMENTS 1,254,161 A * 1/1918 Sawyer ..... B21G 1/04 264/249
2,393,155 A * 1/1946 Gaspar ..... B23D 15/002 225/2
(Continued)

FOREIGN PATENT DOCUMENTS

DE 699244 C * 11/1940 ..... B21G 1/04
DE 69311629 11/1997
(Continued)

OTHER PUBLICATIONS

European Search Report for EP Patent No. 20167558.4, dated Oct. 23, 2020; 7 pages.

*Primary Examiner* — Aiying Zhao
(74) *Attorney, Agent, or Firm* — Fitch, Even, Tabin & Flannery LLP

(57) ABSTRACT

A textile tool part pair (15) consisting of two textile tool parts (16) and a method of equipping a textile machine with the aid of such a textile tool part pair (15) are disclosed. Each textile tool part (16) extends in a longitudinal direction (L) between a trailing end (21) and a leading end (22). Proceeding from the trailing ends (21) thereof, the textile tool parts (16) extend away from one another and counter to one another as far as the leading end (22). At the trailing ends (21), the two textile tool parts (16) of a common textile tool part pair (15) are interconnected by a predetermined breaking connection (45). The predetermined breaking connection (45) can be manually separated without tools, in particular by bending about a bending axis (A).

16 Claims, 4 Drawing Sheets

(51) Int. Cl.

| | |
|---|---|
| ***D04B 27/04*** | (2006.01) |
| ***D04B 35/04*** | (2006.01) |
| ***D04B 35/06*** | (2006.01) |

(58) Field of Classification Search
CPC ..... B21G 1/04; B21G 1/06; Y10T 29/49789; Y10T 29/4979; Y10T 29/49787
See application file for complete search history.

(56) References Cited

U.S. PATENT DOCUMENTS

| | | | | | |
|---|---|---|---|---|---|
| 2,696,721 | A * | 12/1954 | Shortland | D04B 35/08 | 163/3 |
| 3,973,413 | A * | 8/1976 | Tichenor | D04B 5/00 | 66/90 |
| 4,541,470 | A * | 9/1985 | Pavel | B21G 1/04 | 163/5 |
| 4,905,364 | A * | 3/1990 | Berentzen | B21G 1/06 | 29/418 |
| 2004/0244429 | A1* | 12/2004 | Fehrenbacher | D04B 37/00 | 66/116 |
| 2010/0229772 | A1* | 9/2010 | Turner | D05B 85/02 | 112/224 |

FOREIGN PATENT DOCUMENTS

| | | |
|---|---|---|
| DE | 10148196 | 4/2003 |
| DE | 102009051612 | 5/2011 |
| DE | 102013104189 | 11/2013 |
| DE | 102014103261 | 9/2015 |
| EP | 1486600 | 12/2004 |
| EP | 2128319 | 12/2009 |
| EP | 2767626 | 8/2014 |
| WO | 2009095359 | 8/2009 |

* cited by examiner 15
22
49
29,31
28
26
27
25
30
40
41
44
E
A
17,18
16
21
45
H
L
34
35
17,19
A,S
16,17,19
31

TEXTILE TOOL PART PAIR AND METHOD FOR EQUIPPING A TEXTILE MACHINE

CROSS REFERENCE TO RELATED APPLICATIONS

This patent application is the national phase of PCT/EP2021/058194 filed Mar. 29, 2021, which claims the benefit of European Patent Application No. 20167558.4 filed Apr. 1, 2020.

TECHNICAL FIELD

The invention refers to a textile tool part pair consisting of two textile tool parts. The textile tool parts are configured for being inserted in respective seatings of a textile machine. Particularly the textile tool parts are used during loop formation, loop transfer or manipulation of a thread during textile production, e.g. knitting tool parts. The textile tool parts are inserted into a tool seating of a textile machine or, for example, in a groove-like guide channel of a knitting machine. The textile or knitting tool parts are arranged in a movably guided manner along a guide channel. The two textile tool parts of a common textile tool part pair can be a complete textile tool respectively or can together form a textile tool. The textile tool can be, for example, a sinker, a transfer part or transfer needle, a knitting needle, e.g. a latch needle, a warp knitting needle, a slider for a slider needle, a sewing needle or another textile tool used during loop formation or transfer of loops.

BACKGROUND

Textile tools for use during the loop formation in textile machines, particularly knitting needles, are known in many configurations. For example, WO 2009/095359 A1 describes a transfer needle for transfer of loops from the needle to an adjacent needle.

A textile tool for a flat bed knitting machine is described in EP 2 767 626 A1. The textile tool is formed of two flat parts that are connected with each other.

DE 10 2014 103 261 A1 proposes to manufacture a thread-guiding textile tool for knitting or warp knitting machines by stamping and bending. Thereby two webs of a textile tool are stamped and subsequently placed on top of one another or folded on top of one another.

The method according to DE 693 11 629 T2 provides to manufacture a textile tool, according to the example a sinker, by stamping from a metal strip having sections of different thickness.

A textile tool part with stepped thickness is known from EP 2 128 319 A1 in which two parts of uniform thickness and different contour are manufactured that are subsequently placed laterally against one another.

DE 10 2013 104 189 A1 describes a sinker pair in which the two sinkers of the sinker pair have a reduced thickness and are inserted together in a channel of a sinker cam.

DE 101 48 196 C1 discloses a textile tool and according to the example a knitting needle. The textile tool has parts that are movably supported on one another. The two parts are connected with each other by substance bond for simplifying the handling such that the connection is broken during the first use in the machine and a relative movement of the two parts is possible.

Starting from the prior art it can be considered as object of the present invention to improve the manufacturing and/or handling of a textile tool.

SUMMARY

This object is solved by a textile tool part pair and a method for equipping a textile machine using a textile tool part pair as described herein.

According to the invention a textile tool part pair consists of two textile tool parts. The two textile tool parts can be configured identically or can have identical contours or can be configured symmetrically with reference to a symmetry plane that extends at the connection location between the two textile tool parts. Each textile tool part preferably extends in a longitudinal direction between a front end and a back end. In addition, each textile tool part has a working section that is configured to get into contact with a thread during loop formation or during movement or transfer of loops or to comply with another task during textile production. The working section can directly adjoin the front end. The working section is arranged with distance to the back end.

The two textile tool parts of a common textile tool part pair are at or by means of their back ends connected with each other by a predetermined breaking connection that can be separated manually and without use of tools. The predetermined breaking connection is separated and, for example, broken by bending about a bending axis extending orthogonal to the longitudinal direction. After the separation of the two textile tool parts, they can be inserted and used in the textile machine separately or together. As long as the predetermined breaking connection is established, the two textile tool parts have a relative position or orientation that does not correspond to the required relative position or relative orientation during use in the textile machine. Particularly the insertion of the textile tool parts in the textile machine is impossible as long as the predetermined breaking connection is established.

The two textile tool parts can be manufactured together as integral component. This can be advantageous, especially for very small textile tool parts, because the handling during manufacturing of the totally longer part, i.e. the integral textile tool part pair, is simplified. In doing so, the efficiency during manufacturing can be increased, because two textile tool parts can be transferred to a processing station or processing center concurrently and can be received again therefrom. In addition, the accuracy of manufacturing of two textile tool parts that cooperate in a textile machine can be increased, because the relative position between the two textile tool parts during the processing during manufacturing is known and thus features of the textile tool part can be very precisely created with relation to the position of features of the respective other textile tool part. This can also result in an increased manufacturing accuracy and can reduce the post-processing requirement or adjustment requirement during use.

The handling also during equipping of a textile machine can be remarkably simplified. Cooperating textile tool parts or textile tool parts that are always used in pairs, e.g. machine knitting needles with different foot position or non-symmetric needles used in pairs, as known for example from EP 3 124 664 A1, can be provided as textile tool part pair with predetermined breaking connection. In doing so, two textile tool parts that form a set can be commonly handled until just before the insertion in the textile machine. Errors due to insertion of non-matching textile tool parts can be avoided in this manner.

It is advantageous, if the predetermined breaking connection comprises at least one web that extends between the two back ends of the textile tool parts. The at least one web comprises a smaller cross-section area compared with the adjoining back ends of the textile tool parts, e.g. a smaller thickness in a transverse direction and/or a smaller height in a height direction. The height direction and the transverse direction are orientated orthogonal to the longitudinal direction respectively and orthogonal with regard to each other and form together with the longitudinal direction a Cartesian coordinate system.

Preferably the at least one web is integrally configured with the two textile tool parts. Thus, the at least one web consists of the same material as the two textile tool parts. Particularly the at least one web and the textile tool parts consist of a metal or a metal alloy, e.g. a steel alloy. The at least one web can be manufactured by a cutting process and/or by a non-cutting forming method. For example, the at least one web can be manufactured by stamping or another cutting method and/or by embossing.

In a preferred embodiment the at least one web extends between two end surfaces of the back ends that are facing each other. Preferably the end surfaces are substantially orientated orthogonal to the longitudinal direction. They can extend in a plane that is defined by the height direction and the transverse direction.

Preferably the textile tool parts extend opposite to each other originating from the predetermined breaking connection in a common longitudinal direction up to its respective front end.

The predetermined breaking connection can be configured to allow a bending of the textile tool parts about a bending axis that extends orthogonal to the longitudinal direction. Preferably the bending axis extends in height direction. In addition, the predetermined breaking connection can be configured to impede a bending about an axis parallel to the longitudinal direction and/or parallel to the transverse direction, such that a bending about the bending axis extending in height direction is exclusively allowed. The bending axis can extend, for example, parallel to the end surfaces of the two ends facing one another.

It is in addition advantageous, if each of the two textile tool parts comprises a base surface that extends along a common reference plane. The common reference plane is preferably defined by the longitudinal direction and the transverse direction. Thus, the reference plane can be orientated orthogonal to the bending axis.

In a preferred embodiment the reference plane can be a contact plane that is brought into contact from below against the textile tool part pair until the base surfaces extend in the reference plane. In this condition no portions of the textile tool parts or the textile tool part pair extend through the reference plane.

The base surfaces of the two textile tool parts can be arranged with distance to one another in longitudinal direction. Each textile tool part comprises particularly exactly one base surface that is preferably configured continuously without interruptions in longitudinal direction. In some embodiments the base surface can be separated in sections that are distanced from one another in longitudinal direction.

The base surfaces can be used as support surfaces during the handling of the textile tool part pair during the manufacturing process or after the manufacturing during shipping. In doing so, the support of the textile tool part pair can be improved compared with individual textile tool parts.

In a preferred embodiment the two textile tool parts are configured to be placed against one another after separation of the predetermined breaking connection in order to form a common textile tool. For this each textile tool part can have an abutment surface. Prior to the separation of the predetermined breaking connection, the two abutment surfaces are arranged with distance to each other and extend preferably in a common plane. This common plane can be defined by the longitudinal direction and the height direction. The two textile tool parts can be sinker parts that commonly form a sinker after abutment against one another.

For equipping a textile machine it is proceeded as follows:

First, a textile tool part pair according to one of the embodiments described above is provided. Subsequently the two textile tool parts of the textile tool part pair are separated from one another at the predetermined breaking connection. The predetermined breaking connection is configured such that the separation can be carried out manually and without tools. After the separation of the textile tool parts from each other the textile tool parts are inserted in their operating position in the textile machine. In the operating position the two textile tool parts can abut against each other and can together form a textile tool, e.g. a sinker, a transfer part or another textile tool. The two textile tool parts can, however, also be inserted individually in different guide channels of a textile machine, particularly a knitting machine.

Preferably the separation of the two textile tool parts is carried out by bending about a bending axis. The bending axis can extend parallel to the back ends of the two textile tool parts, particularly parallel to the end surfaces of the two ends facing one another.

It is advantageous, if the textile tool parts can be inserted without further post-processing in the textile machine or in the respective guide channel or in the respective tool seating. Potentially present breaking parts or breaking surfaces at the back ends are not removed. They are uncritical for the use of the textile tool parts in the textile machine.

BRIEF DESCRIPTION OF THE DRAWINGS

Preferred embodiments of the invention are derived from the dependent claims, the description and the drawings. In the following preferred embodiments of the invention are explained in detail with reference to the attached drawings. The drawings show:

DETAILED DESCRIPTION

Figures 1, 2, 3:
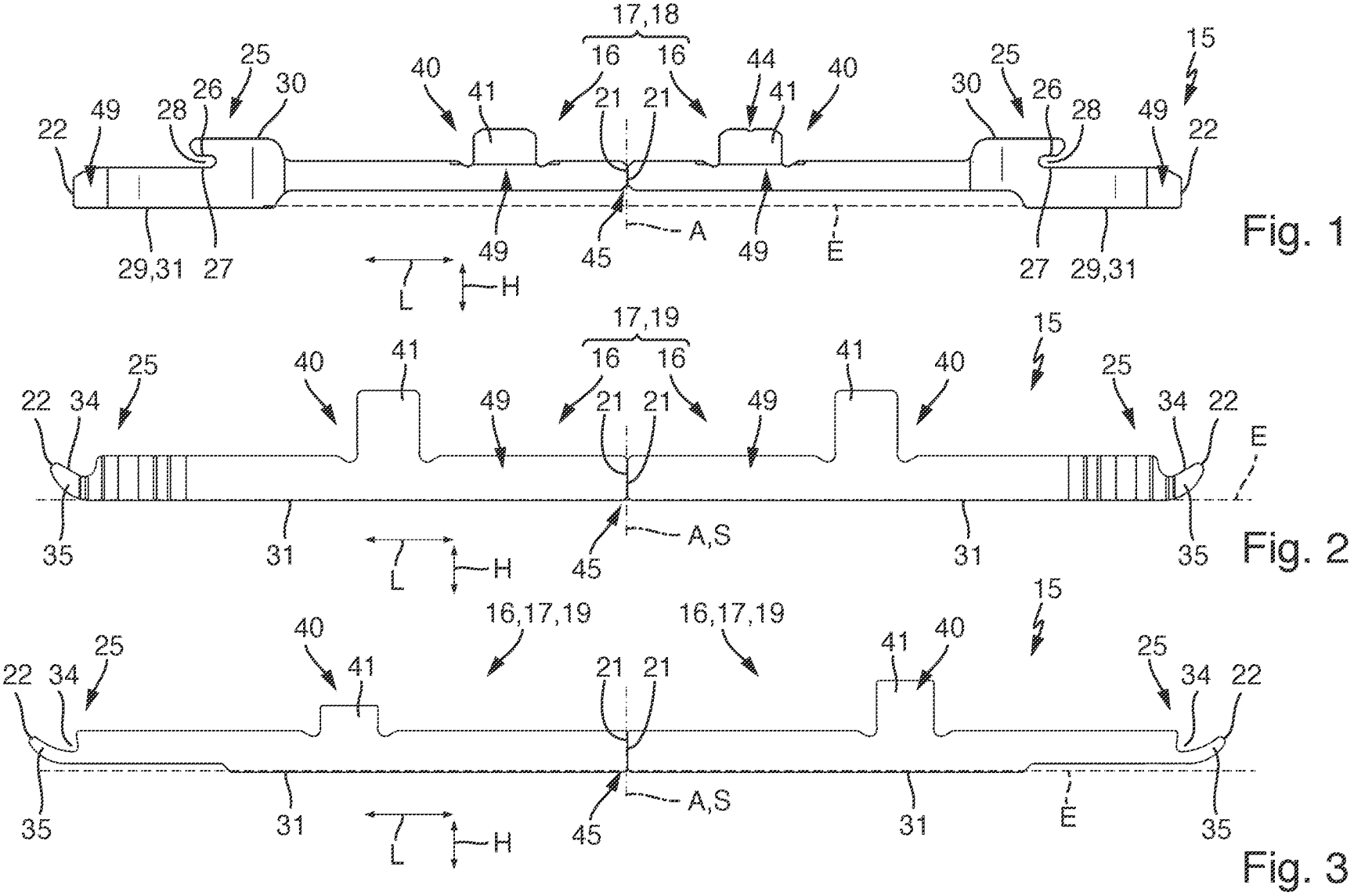
FIGS. 1-5 an embodiment of a textile tool part pair respectively having two textile tool parts that are connected with each other at a predetermined breaking connection, FIGS. 6-8 different embodiments of a predetermined breaking connection in a top view on the textile tool part pair in schematic illustration respectively, FIGS. 9 and 10 a schematic illustration of an embodiment of a predetermined breaking connection in a lateral view respectively, FIG. 11 schematic basic illustration of the separation of the predetermined breaking connection by bending about a bending axis and FIG. 12 a schematic view of a textile tool part in form of a sinker that consists of two separated textile tool parts and is inserted into a guide channel of a textile machine.

FIGS. 1-5 show different embodiments of a textile tool part pair 15 respectively consisting of exactly two textile tool parts 16. The two textile tool parts 16 of a textile tool part pair 15 are either an individually usable textile tool 17 or form two textile tool parts 16 that fit together and that together form a textile tool 17. In FIGS. 1 and 2 textile tool part pairs 15 are illustrated respectively in which the two textile tool parts 16 together form one single functional textile tool 17 after insertion in a textile machine, e.g. a sinker 18 (FIG. 1) or a transfer part 19 for transfer of loops. The sinker 18 formed of the two textile tool parts 16 is illustrated schematically in FIG. 12 in top view.

Figure 4:
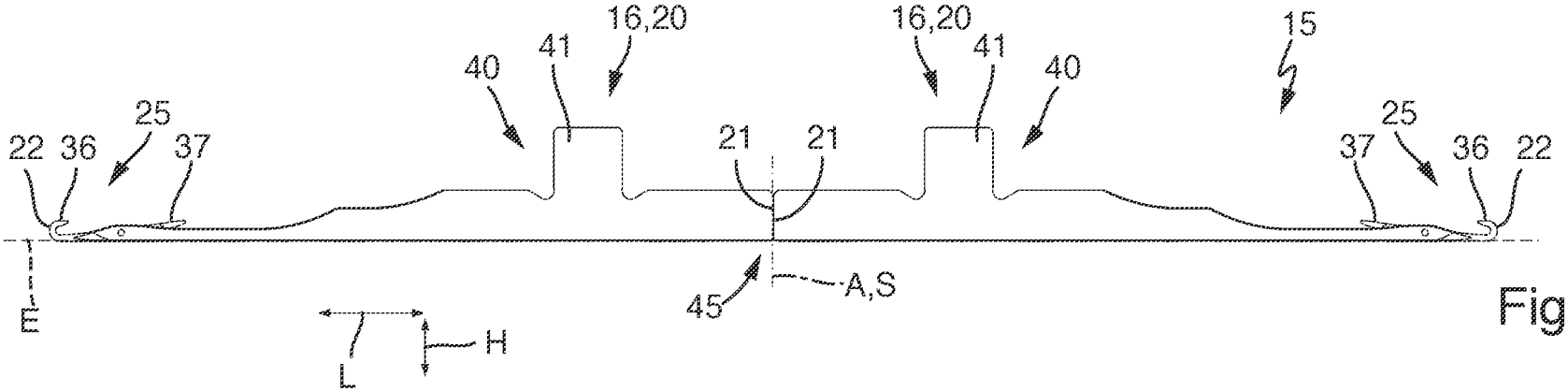
Figure 5:
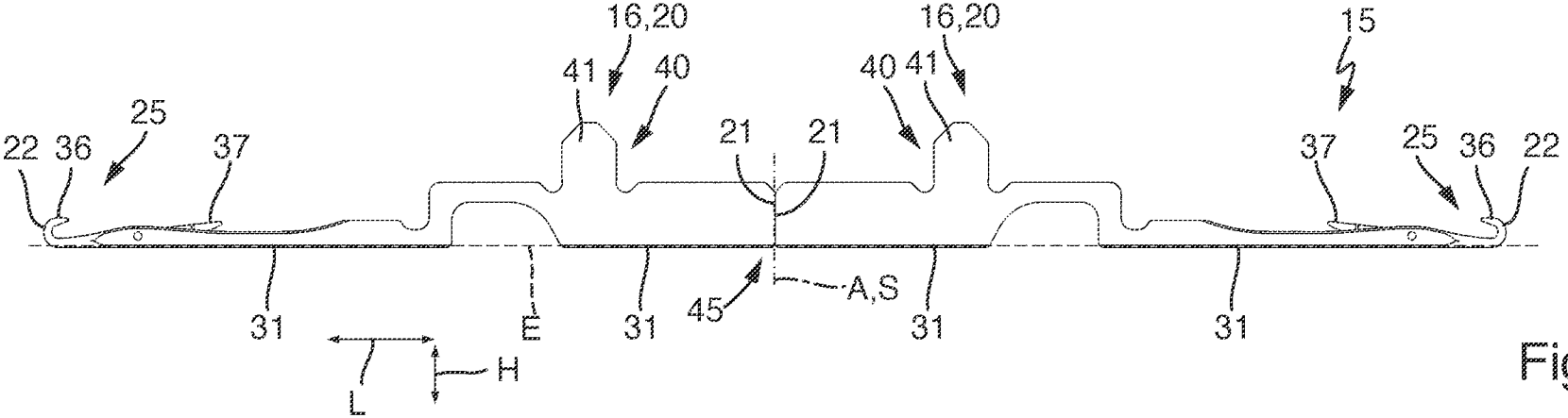

Different to FIGS. 1 and 2, the two textile tool parts 16 according to FIGS. 3-5 already form an individual textile tool 17 respectively and according to the example, a machine knitting needle that is configured as latch needle 20 in the embodiments illustrated here.

The two textile tool parts 16 of each textile tool part pair 15 extend in a longitudinal direction L between a back end 21 and a front end 22. Each textile tool part 16 comprises a working section 25 that gets into contact with a thread during use of the textile tool part 16 in a respective textile machine, particularly during a loop forming process or during transfer or manipulation of loops or a thread and thus contributes to the textile manufacturing and particularly to the loop formation. In the working section 25 the textile tool parts 16 comprise for the formation of the sinker 18 (FIG. 1) a hold-down edge 26 and a knock-over edge 27 respectively that are arranged with distance to each other in a height direction H and substantially above each other. The hold-down edge 26 and the knock-over edge 27 extend substantially in longitudinal direction L and/or parallel with each other according to the example. The hold-down edge 26 and the knock-over edge 27 are facing each other. They limit a holding space 28 that is open in longitudinal direction toward the front end 22.

The textile tool part 16 extends in height direction H in the working section 25 between a bottom edge 29 and a top edge 30 for forming the sinker 18. The bottom edge 29 and the top edge 30 are orientated parallel to one another according to the example. The bottom edge 29 extends in longitudinal direction L and also comprises an extension in a transverse direction Q orthogonal to the height direction H and orthogonal to the longitudinal direction L. The bottom edge 29 forms a base surface 31 of the textile tool part 16.

As apparent from FIG. 1, the two base surfaces 31 of the textile tool parts 16 of the common textile tool part pair 15 extend in a common reference plane E that is defined by the longitudinal direction L and the transverse direction Q. Preferably no components of the textile tool part pair 15 extend through the reference plane E. The reference plane E is a contact plane according to the example that is brought into contact from below with the bottom edges 29 or base surfaces 31 until the bottom edges 29 or the base surfaces 31 extend in the reference plane E. This has the advantage that both bottom edges 29 or base surfaces 31 of the common textile tool part pair 15 can be used as common support surface during manufacturing of the two textile tool parts 16, e.g. during transport of the parts or during arrangement in a machine tool.

As apparent from FIGS. 1-5, the working section 25 of each textile tool part 16 is arranged with distance to the back end 21 and is preferably located closer to the front end 22 as to the back end 21. In some embodiments the working section 25 can directly adjoin the respective front end 22, e.g. in the textile tool part 16 for forming the transfer parts 19 (FIGS. 2 and 3) as well as in the latch needles 20 (FIGS. 4 and 5).

In the working sections 25 of the textile tool parts 16 for forming the transfer parts 19 a loop holding recess 34 is present respectively that is open toward the top. The textile tool part 16 forms a transfer hook 35 for forming the transfer part 19 that tapers toward the front end 22 and that is curved, for example, below the loop holding recess 34 (with view in height direction H).

In the latch needles 20 shown in FIGS. 4 and 5 a needle hook 36 is arranged in the working section 25 respectively at which the front end 22 of the textile tool part 16 is located. The hook inner region of the needle hook 36 can be opened by a latch 37 (as illustrated in FIGS. 4 and 5) or can be closed by pivoting the latch 37.

Each textile tool part 16 comprises a drive section 40 between the working section 25 and the back end 29. A foot 41 projecting in height direction H is provided in the drive section 40, wherein the foot 41 is configured to cooperate with a cam in the textile machine in order to drive the textile tool, e.g. the sinker 18, the transfer part 19 or the latch needle 20, and to move it in longitudinal direction L along a guide channel 42. The guide channel 42 is schematically and by way of example illustrated in FIG. 12 for the sinker 18.

The textile tool part pair 15 according to FIG. 1 is arranged with distance to the reference plane E outside the bottom edge 29 or base surface 31 in the working section. The bottom edge 29 or the base surface 31 adjoins the front end 22 directly according to the example. Because the two textile tool parts 16 are handled as common textile tool part pair 15 during manufacturing, a support that is resistant against tilting can be achieved by means of the base surfaces 31.

In all textile tool parts 16 of the textile tool part pair 15 according to FIGS. 1-5 a reference plane E forming a contact surface is brought into abutment from below against the base surfaces 31 of the textile tool parts 16, whereby no components of the respective textile tool part pair 15 extend through the reference plane E.

The base surfaces 31 can be continuous without interruptions in longitudinal direction L (FIGS. 1-4) or can be separated into multiple sections by means of an interruption (FIG. 5). In the embodiment according to FIG. 1, the base surfaces 31 are arranged close to the front end 22 or directly adjoining the front end 22 and comprise a larger distance to the respective back end 21 as to the front end 22. In another embodiment the base surface 31 can be arranged closer to the back end 21 than to the front end 22 (FIG. 3). In still other embodiments the base surface 31 can extend nearly completely from the front end 22 or at least from the working section 25 up to the back end 21 (FIGS. 2 and 4).

At the back ends 21 facing each other, the two textile tool parts 16 of a common textile tool part pair 15 are connected with each other by means of a predetermined breaking connection 45. The textile tool part pair 15 is thus a unit, whereby the two textile tool parts 16 of the textile tool part pair 15 are produced and transported during manufacturing together as one unit. The predetermined breaking connection 45 is separated only directly before the arrangement of the textile tool parts 16 in a textile machine.

Preferably the two textile tool parts 16 of a common textile tool part pair 15 can be configured symmetrically with reference to symmetry plane S. The symmetry plane can extend centrally between the two textile tool parts 16 and can be orientated orthogonal to the longitudinal direction L.

In the embodiment according to FIG. 1 the bottom edges 29 of the textile tool part 16 have different lengths in order to be able to distinguish the textile tool part 16 after separation. Alternatively or additionally, also other geometric features and/or markings can be provided by means of which two textile tool parts 16 of a common textile tool part pair 15 can distinguish from each other. For example, a notch 44 or another marking can be introduced or arranged in a foot 41 or at another suitable location of one of the two textile tool parts 16.

The predetermined breaking connection 45 is illustrated in FIG. 6-11 by way of example. It is configured to be separated manually and without use of tools. Also a tool can be used for separation, however this is not necessary.

The predetermined breaking connection 45 is formed by at least one web 46 according to the example that extends between the back ends 21 of the two textile tool parts 16. The at least one web 46 has a smaller dimension in transverse direction Q and/or in height direction H as the two directly adjoining back ends 21. Thus, it forms a weakness that can be separated or broken. The dimensioning of the at least one web 46 is selected such that it can be separated or broken manually and without use of tools by an operating person during equipping of a textile machine.

According to the example, each back end 21 of a textile tool part 16 has an end surface 47, whereby the at least one web 46 extends between the two end surfaces 47 facing each other. The end surfaces 47 extend, according to the example, parallel to the height direction H and can be orientated substantially orthogonal to the longitudinal direction L (FIGS. 7, 9 and 10) or can be orientated obliquely inclined with regard to the longitudinal direction L and/or the transverse direction Q, wherein the angle between the end surfaces 47 and the longitudinal direction L is preferably deviating from the right angle about at most 20° or at most 10°.

The at least one web 46 is preferably integrally configured with the two textile tool parts 16. Thus, the at least one web 46 comprises no seam or joint location. Preferably the textile tool part pair 15 as a whole is configured integrally or manufactured integrally. The at least one predetermined breaking connection 45 that is formed by the at least one web 46 according to the example, can be created by a chip removing process and/or a stamping process and/or a forming process. Preferably the at least one web 46 is formed by a stamping process and/or a forming process (e.g. embossing) between the two back ends 21 or the two end surfaces 47.

Figure 9:
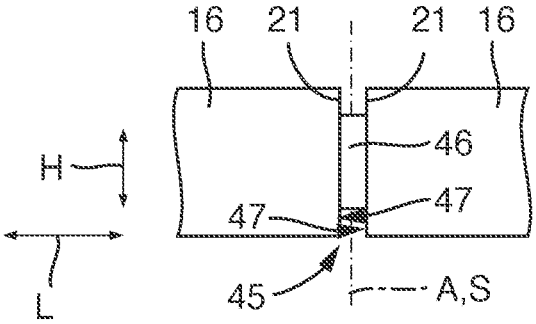
Figure 10:
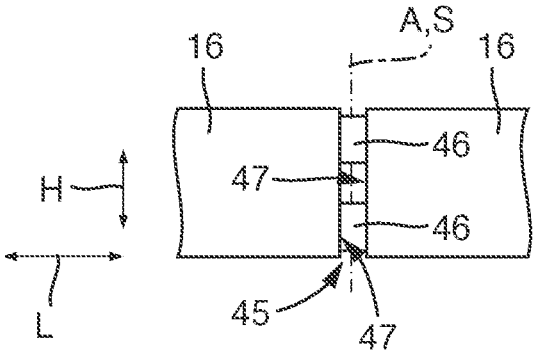

As apparent from FIG. 9, one single web 46 can be provided that extends between the two back ends 29 or the two end surfaces 47. Alternatively thereto, it is also possible to provide multiple webs 46 that are arranged with distance to each other in height direction H. Preferably the predetermined breaking connection 45 does not comprise a multiplicity of webs 46 arranged adjacent to one another in transverse direction Q. If multiple webs 46 are provided, they are particularly exclusively arranged adjacent to one another in height direction H.

Figure 6:
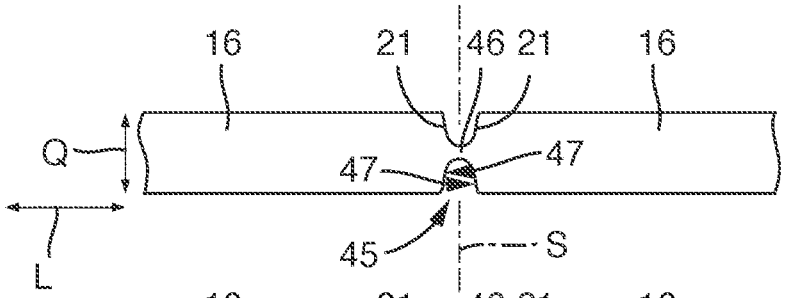
Figure 7:
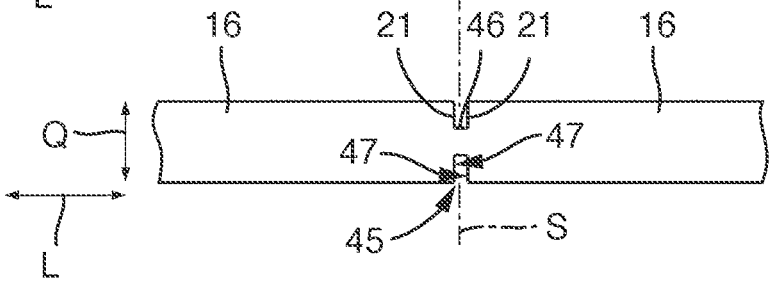
Figure 8:
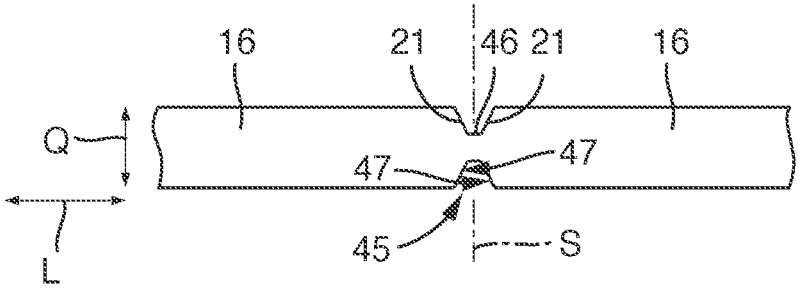

The shape of a recess or an embossment between the two back ends 21 or the two end surfaces 47 for forming of a web 46 that is thinner in transverse direction Q relative to the back ends 21 can vary, as schematically illustrated in FIGS. 6-8 by way of example. The recess or opening provided on opposite sides of the at least one web 46 in transverse direction Q can have a rounded shape with parallel or inclined legs extending obliquely with regard to each other (compare e.g. FIG. 6). The depression can alternatively thereto also have a rectangular cross-section (FIG. 7) or another polygonal cross-section, e.g. a trapezoidal cross-section (FIG. 8).

In the preferred embodiment the predetermined breaking connection 45 is configured to define a bending axis A that extends in height direction H according to the embodiment. During bending of the two textile tool parts 16 around the bending axis A the at least one web 46 of the predetermined breaking connection 45 breaks, such that the two textile tool parts 16 are separated from each other. Preferably the predetermined breaking connection 45 or the at least one web 46 is configured such that a bending around an axis is impeded that is orientated parallel to the transverse direction Q or parallel to the longitudinal direction L. Preferably the total height of the at least one web 46, that is of one single web 46 or of all of the present webs 46, is higher than its dimension in longitudinal direction L and/or in transverse direction Q.

Figure 11:
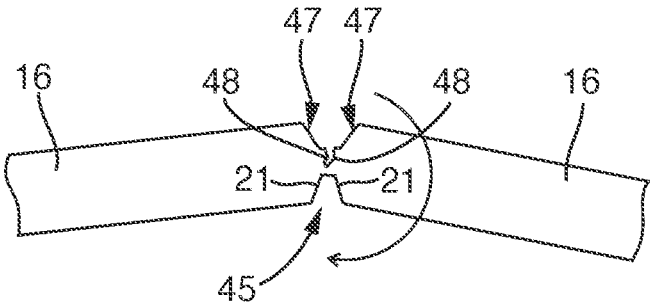

The bending of the two textile tool parts 16 of a common textile tool part pair 15 around the bending axis A is schematically illustrated in FIG. 11, wherein the bending axis A extends orthogonal to the drawing plane.

Figure 12:
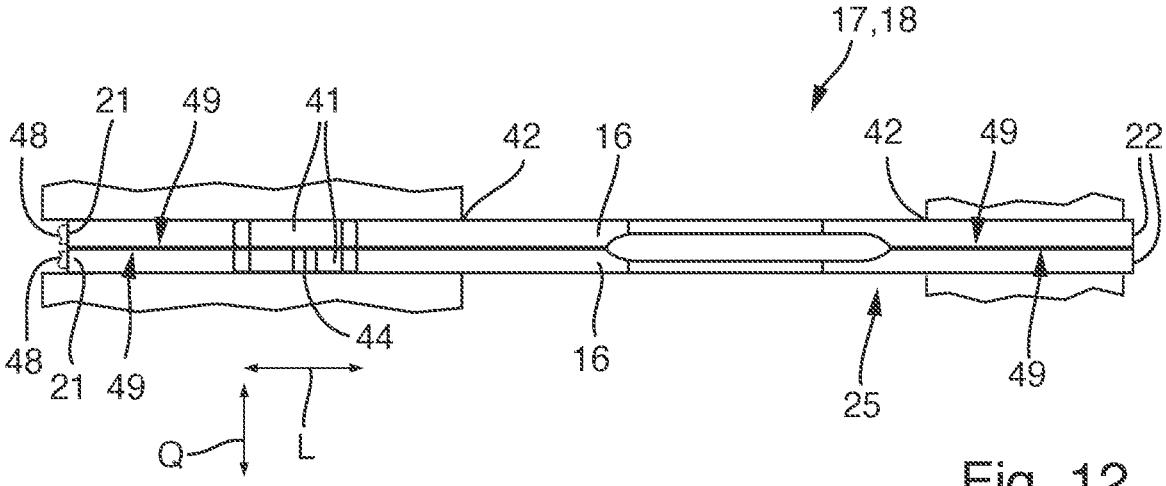

After the separation of the predetermined breaking connection 45, a breaking part 48 or a breaking surface of the broken web 46 remains at each back end 21 or each end surface 47 of the two textile tool parts 16 (FIGS. 11 and 12). The textile tool parts 16 are inserted into the textile machine or in the respective guide channel 42 without further post-processing, as illustrated in FIG. 12. The remaining breaking parts 48 or breaking surfaces at the back ends 21 are uncritical for the use of the textile tool parts 16 in the textile machine. They are distanced from the working section 25 and do not get into contact with the at least one thread during the textile production. They are also not in contact with the guiding surface of the guide channel 42 such that no increased wear is created by the breaking parts 48 or the breaking surfaces of the broken web 46.

During equipping of a textile machine the at least one textile tool part pair 15 is taken from a stock, the two textile tool parts 16 are separated from each other by separating the predetermined breaking connection 45 and the two textile tool parts 16 can be inserted in the assigned guide channel 42 without further subsequent post-processing.

In the embodiment illustrated in FIGS. 1 and 12 the two textile tool parts 16 are at least in sections arranged in a common guide channel 42 and together form a sinker 18. For this each textile tool part 16 comprises an abutment surface 49, wherein the two abutment surfaces 49 abut against each other for forming the sinker 18 (FIG. 12). In the embodiment the two abutment surfaces 49 extend at least along the drive section 40 of each textile tool part 16. Each abutment surface 49 is orientated parallel to the longitudinal direction L and parallel to the height direction H. The abutment surfaces 49 can be particularly configured without openings and provide a two-dimensional contact between the two textile tool parts 16.

Also in the embodiment illustrated in FIG. 2 the two textile tool parts 16 are configured to be brought into abutment against one another with their abutment surfaces 49 in order to form the transfer part 19.

LIST OF REFERENCE SIGNS

15 textile tool part pair
16 textile tool part
17 textile tool
18 sinker
19 transfer part
20 latch needle
21 back end
22 front end
25 working section
26 hold-down edge
27 knock-over edge
28 holding space
29 bottom edge
30 top edge

31 base surface
34 loop holding recess
35 transfer hook
36 needle hook
37 latch
40 drive section
41 foot
42 guide channel
44 notch
45 predetermined breaking connection
46 web
47 end surface
48 breaking part
49 abutment surface
A bend axis
E reference plane
H height direction
L longitudinal direction
Q transverse direction
S symmetry plane

The invention claimed is:

1. A textile tool part pair (15) consisting of two textile tool parts (16), the two textile tool parts comprising:

bodies of the two textile tool parts (16) that are respectively configured for insertion in a guide channel or a tool seating of a textile machine;

wherein each of the two textile tool part (16) bodies extends in a longitudinal direction (L) between a front end (22) and a back end (21) and comprises a working section (25) that is arranged at a distance to the back end (21) configured to be used for thread contact and/or loop formation;

wherein the two textile tool part (16) bodies are connected with each other at their back ends (21) by a breaking connection (45) that is configured to be separated manually and without use of tools;

wherein the textile tool part (16) bodies extend away from each other from the breaking connection (45) to their respective front end (22);

wherein the breaking connection (45) comprises at least one web (46) that extends between the two back ends (21) of the two textile tool part (16) bodies; and wherein the two textile tool part (16) bodies and the at least one web (46) of the breaking connection (45) are of a metal or metal alloy material.

2. The textile tool part pair according to claim 1, wherein the breaking connection (45) has a smaller cross-sectional area compared with the back ends (21) of the two textile tool part (16) bodies.

3. The textile tool part pair according to claim 2, wherein the at least one web (46) is configured integrally with the two textile tool part (16) bodies.

4. The textile tool part pair according to claim 2, wherein the at least one web (46) extends between two end surfaces (47) of the back ends (21) facing one another.

5. The textile tool part pair according to claim 1, wherein the breaking connection (45) is configured to allow a bending of the textile tool parts (16) around a bending axis (A) extending orthogonal to the longitudinal direction (L).

6. The textile tool part pair according to claim 1, wherein each of the two textile tool part (16) bodies has a base surface (31) that extends along a common reference plane (E) that is defined by the longitudinal direction (L) and a transverse direction (Q) transverse to the longitudinal direction (L).

7. The textile tool part pair according to claim 6, wherein the breaking connection (45) is configured to allow a bending of the textile tool parts (16) around a bending axis (A) extending orthogonal to the longitudinal direction (L), wherein the bending axis (A) extends orthogonal to the base surfaces (31) of the textile tool part (16) bodies.

8. The textile tool part pair according to claim 7, wherein the common reference plane (E) is a contact plane that is brought into contact with the textile tool part pair (15) from below until the base surfaces (31) extend in the common reference plane (E), whereby no components of the textile tool part pair (15) extend through the common reference plane (E).

9. The textile tool part pair according to claim 1, wherein each of the two textile tool part (16) bodies comprises an abutment surface (49), wherein the abutment surfaces (49) are arranged at a distance to each other prior to separation of the breaking connection (45) and are configured to be brought into abutment against each other after separation of the breaking connection (45), such that the two textile tool parts (16) form a textile tool (18, 19).

10. The textile tool part pair according to claim 9, wherein the textile tool formed from the two textile tool parts (16) is a sinker (18) for a knitting machine.

11. A method for equipping a textile machine with the textile tool part pair (15) of claim 1, the method comprising the following steps:

separating the two textile tool parts (16) of the textile tool part pair (15) at the breaking connection (45) manually without use of tools; and inserting the separated textile tool parts (16) in a guide channel (42) or a tool seating of the textile machine.

12. The method according to claim 11, wherein separating the two textile tool parts (16) of the textile tool part pair (15) manually without use of tools is carried out by bending around a bending axis (A) that extends between the two back ends (21) of the two textile tool parts (16).

13. The method according to claim 12, wherein the two separated textile tool parts (16) are inserted in the respective guide channel (42) or the tool seating without further post-processing.

14. The textile tool part pair according to claim 1, wherein a height of the at least one web (46) is smaller than a height of the back ends (21) of the bodies of the two textile tool parts (16).

15. The textile tool part pair according to claim 1, wherein a thickness of the at least one web (46) is smaller than a thickness of the back ends (21) of the bodies of the two textile tool parts (16).

16. The textile tool part pair according to claim 1, wherein the at least one web (46) comprises at least two webs (46) that are spaced apart from one another in a height direction (H), wherein the height direction (H) is orthogonal to the longitudinal direction (L).

* * * * *